United States Patent [19]

Monahan

[11] Patent Number: 5,020,284

[45] Date of Patent: Jun. 4, 1991

[54] SELF-BIASING HONING TOOL

[76] Inventor: James G. Monahan, 4733 - 122nd Ave. North, Clearwater, Fla. 34622

[21] Appl. No.: 449,646

[22] Filed: Dec. 12, 1989

[51] Int. Cl.[5] ..... B24D 17/00

[52] U.S. Cl. ..... 51/338; 51/352; 51/353

[58] Field of Search ..... 51/338, 331, 352, 353

[56] References Cited

U.S. PATENT DOCUMENTS 3,998,011 12/1976 Corley ..... 51/338

FOREIGN PATENT DOCUMENTS 1652075 1/1971 Fed. Rep. of Germany ..... 51/358

*Primary Examiner*—Maurina Rachuba

*Attorney, Agent, or Firm*—Joseph C. Mason; Ronald E. Smith

[57] ABSTRACT

A honing tool operated by a common motor or a drill while the part being honed is held by a common vice. A spring is positioned within a tubular sleeve member that is aligned with a boss member formed on the trailing end of a conventional housing for a conventional feedup rod. The leading end of the spring bears against the trailing end of the feedup rod and urges it continuously forwardly so that honing continues for as long as the spring is allowed to bear against the feedup rod. The honing operation can be stopped at any time by pulling back on a ring member that causes the spring to be compressed when pulled back. When the spring is compressed, the bias is taken off the feedup rod and hence the cutting stone, so that the diameter of the bore being honed can be measured. In a second embodiment, the final position of the ring member is marked at the conclusion of a honing operation that is to be repeated and a stop member is set so that subsequent honing operations conclude when the ring member attains the final position and is stopped by the stop member.

8 Claims, 4 Drawing Sheets

Fig_1

SELF-BIASING HONING TOOL

TECHNICAL FIELD

This invention relates, generally, to honing tools. More particularly, it relates to a honing tool that includes biasing means for feeding the stone.

BACKGROUND ART

Honing tools are used for forming bores in various parts.

Bores may also be formed by grinding, but honing as is well known, is the method of choice because it is faster and consistently produces better bores, i.e., bores having closer tolerances to predetermined specifications.

A honing tool typically includes an elongate stone carried at the end of a mandrel; rotation of the mandrel about its longitudinal axis of symmetry effects simultaneous and corresponding rotation of the stone. The stone has longitudinally extending cutting edges that gradually form the desire bore in the part being honed as the stone is rotated.

Importantly, all known honing machines include means for driving the cutting stone radially outwardly with respect to the mandrel as the diameter of the bore being honed increases.

Typically, an elongate wedge member engages the radially inward side of the stone, and means are provided to axially advance the wedge member toward the stone so that the stone is driven radially outwardly as the wedge member advances.

The known honing machines of the prior art employ various sophisticated means for advancing the wedge member so that the radially outwardly advance of the cutting stone can be very carefully controlled. Importantly, one reason the stone-advancing means is so carefully controlled is so that the machine shop owner can set the machine to hone a part to a desired bore diameter and then leave the machine running while other tasks are performed. Thus, since the honing machine is unattended, means must be provided to insure that the machine does not produce a honed bore that has a diameter that exceeds specifications.

A typical sophisticated honing machine that does not require frequent monitoring by an operator is a large, free standing unit that costs over $5,000.00.

Many shops, however, do not employ the honing technique often enough to justify the major expense of a free standing honing machine.

Accordingly, there is a need for an inexpensive honing machine capable of producing high quality honed parts to precise specifications, but the prior art neither teaches nor suggests how such a machine could be built.

DISCLOSURE OF INVENTION

The long standing but heretofore unfulfilled need for a honing machine not subject to the limitations of the prior art devices is now fulfilled in the form of a new, useful and non-obvious improvement to honing tools of the type where a tubular boss means is formed on a trailing end of the housing and where the trailing end of a feed up rod is slidably mounted for axial movement within said boss means.

The improvement includes a tubular sleeve member having a leading end fixedly secured in open communication and axial alignment with a trailing end of said boss means. A bias means is disposed in the tubular sleeve member and a leading end of the bias means is disposed in abutting relation to the trailing end of the feedup rod.

A pair of diametrically opposed, longitudinally extending slot members are formed in the tubular sleeve member, and a bore means is formed in the feedup rod adjacent its trailing end. A linear-in-configuration pin member extends through the slot members and the bore means, and means are provided for retaining the pin member in the slot members and in the bore means.

The means for retaining the pin member includes a feedup ring member of generally toroidal configuration, said feedup ring being centrally honed to slidably receive the tubular sleeve member and the feedup ring member having a pair of diametrically opposed, radially disposed bore means formed therein to accommodate the pin member.

The present invention, then, will be recognized by those skilled in the art as being a modified version of a well known prior art tool built by Sunnen Products Company of St. Louis, Mo.

The Sunnen tool includes a housing with a tubular boss means formed at its trailing end, and a feedup rod having a cylindrical trailing end slidably disposed in that boss means. The leading end of the feedup rod securely engages the wedge member that carries the stone so that the feedup rod and the stone rotate conjointly and so that the axial position of the feedup rod determines the radial position of the stone.

The Sunnen tool includes sophisticated means for axially advancing the feedup rod and hence the wedge member that drives the stone radially outwardly. The sophisticated means includes a rod member that bears against the trailing end of the feedup rod and causes it axially advance. The means for moving the rod member is very satisfactory, but is also complex and costly.

The present invention concerns the means for effecting the axial advancement and axial retraction of the feedup rod and thus does not relate to the stone, the wedge means that drives the stone radially outwardly when advanced, the mandrel that holds the stone and the wedge member, nor the housing and its boss means and the feedup rod slidably disposed therein.

In positive terms, the invention includes the insight that precision means are not required to advance or retract the feedup rod if the small shop owner is willing to closely monitor the honing operation.

In accordance with this insight, a conventional honing tool is modified by fixedly securing a tubular sleeve member to the trailing edge of the boss means integral with the housing member that houses the feedup rod. More particularly, the tubular member is fixedly secured in axial alignment and open communication with the boss means. The trailing end of the conventional feedup rod is slidably disposed in said boss means. In the present invention, said trailing end is slidably disposed in the boss means and the tubular sleeve member, i.e., the axial range of the feedup rod is extended. A bias means is positioned within the tubular sleeve member and its leading end is placed into abutting relation to the trailing end of the feedup rod. An adapter member is introduced into the trailing end of the tubular member to continuously urge the feedup rod forwardly and hence the stone radially outwardly. The adapter member may engage the output shaft of a motor or other motor-operated means such as a drill. Thus, rotation of a motor's or a drill's output shaft effects simultaneous and corresponding rotation of the tubular sleeve member and the feedup rod and hence the cutting stone. The bias means continuously urges further honing of the bore being honed, so it is necessary to stop the honing procedure as needed to measure the diameter of the bore being honed. To avoid overhoning, the measurements are taken at more frequent intervals as the desired bore diameter is approached.

To link the bias means and feedup rod together, a bore means is formed in the feedup rod near its cylindrical trailing end, and a pair of longitudinally extending, diametrically opposed slot means are formed in the tubular sleeve member that houses the bias means. A pin means having an extent greater than the diameter of the tubular sleeve member extends through the slots and the bore means formed in the feedup rod.

The novel pin member is held into position by a novel feedup ring member that is centrally bored so that it axially receives the tubular sleeve member and is carried thereby. The ring member is further bored at a diameter thereof, in intersecting relation to the central bore.

The opposite ends of the pin means that extend radially outwardly from the slot means are slidably received within opposite ends of the diametrically disposed bore means formed in said feedup ring.

Thus, when the honing begins, the feedup ring will be observed near the trailing end of the longitudinally extending slot means. As the honing progresses, the feedup ring will be observed to travel slowly toward the leading end of the slot means.

Importantly, the honing can be interrupted at any time simply by deactivating the motor or drill and by manually grasping the feedup ring and sliding it in the direction opposite to the direction urged by the bias means. Such leading-to-trailing displacement of the feedup ring compresses the bias means and pulls the feedup rod rearwardly and hence retracts the wedge member and effects radial retraction of the cutting stone so that honing is terminated until the feedup ring is released and the means for rotating the tool is reactivated.

In a second embodiment of the invention, means are provided to enable a particular honing operation to be repeated precisely an unlimited number of times, or to be modified slightly with precision. The second embodiment is made possible by the insight that the final position of the novel feedup ring will always be the same for bores of the same diameter. A longitudinally aligned screw threaded stop member is carried eccentrically by the feedup ring and thus advances toward the trailing end of the housing as the honing operation continues. The final position of the feedup ring is noted when the honing has been successfully completed, and the stop member is screw threadedly advanced in the direction of the trailing end of the housing until a head part of the stop member abuts said housing trailing end. In this manner, the final position of the feedup ring is stored in a memory means; thus, the operator need not monitor the tool when subsequent bores of the same diameter are to be formed because the stop member will stop the forward progress of the feedup ring when said stop member head part abuts said housing trailing end. This not only enables additional honing operations to be performed without continual monitoring, it also insures that each honing operation will be precisely the same as the preceding operation. Accordingly, the mass production of precisely honed parts becomes possible with an inexpensive tool.

Moreover, where a second bore is to be honed having a diameter different from a bore already honed, a predetermined number of turns of the screw will readjust the final position of the feedup ring and thus change the diameter of the bore being honed. All the operator of the tool needs to know is the amount of radial displacement of the honing stone associated with one full turn or fractional turn of the stop member. Additional turns of the screw will enable subsequent bores of widely varying diameters to be honed as long as the above-mentioned calibration is known to the tool operator.

It should therefore be understood that a primary object of the present invention is to obviate the need for a small machine shop to purchase an expensive free standing honing machine.

Another object is to provide a honing tool that can be used by any machine shop owning a vice for holding a part to be honed and a means, such as a common motor or hand-held drill, for rotating the tool.

Other objects will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
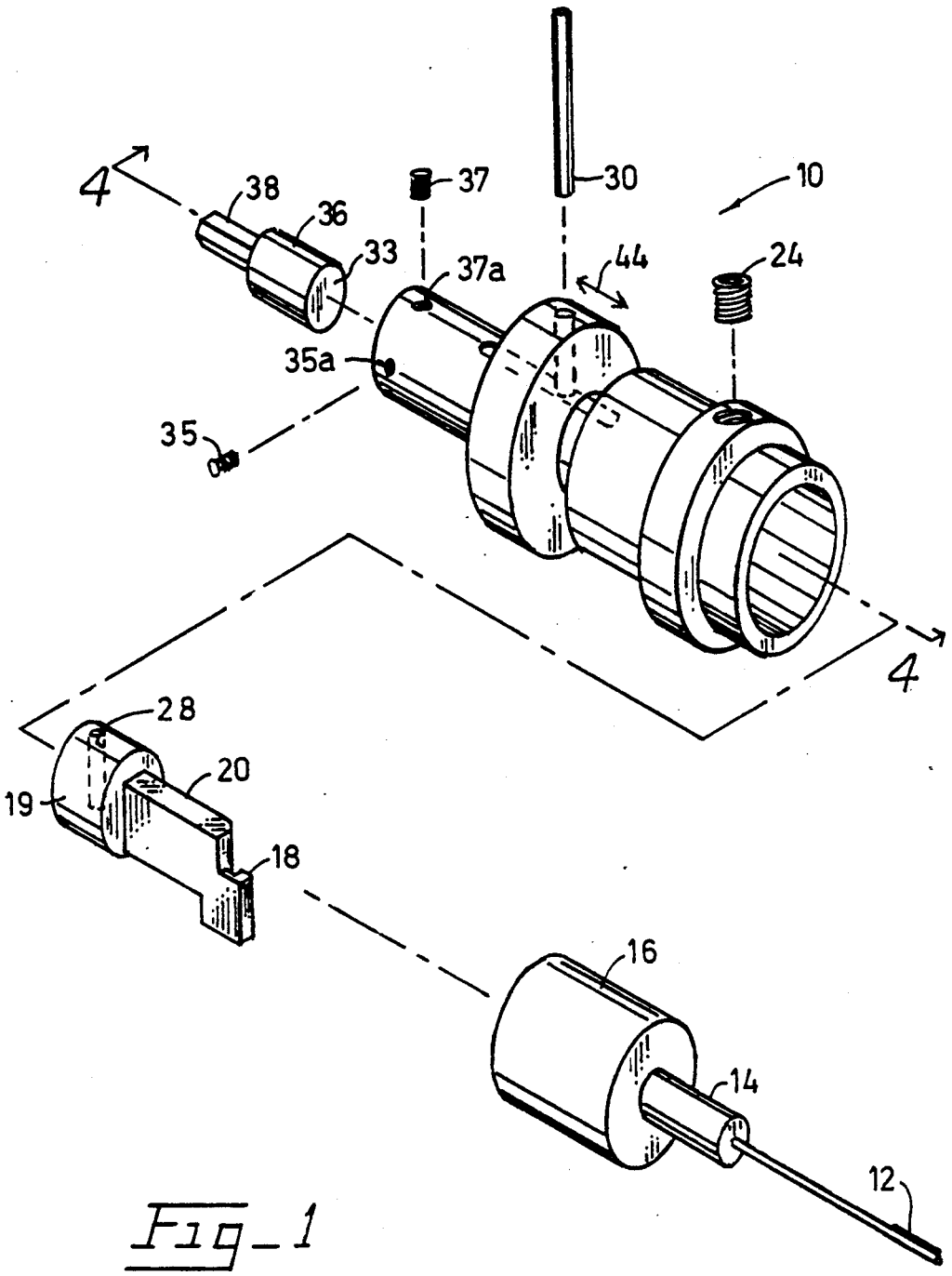
FIG. 1 is an exploded perspective view of an illustrative embodiment of the present invention.

Referring now to FIG. 1, it will there be seen that an illustrative embodiment of the present invention is denoted by the reference numeral 10 as a whole.

Stone 12, shown in phantom lines in the lower right hand corner of FIG. 1, is carried by mandrel 14. The wedge member that drives stone 12 radially outwardly when it is advanced is not shown to simplify the drawing.

The wedge member extends through sleeve member 16 and the trailing end of said wedge member is engaged by the leading end 18 of feedup rod 20.

As indicated by the connecting lines in FIG. 1, sleeve 16 and feedup rod 20 are slidably received within housing 22 of tool 10. A boss means, not shown in FIG. 1, is integral with the trailing end of said housing 22. Set screw 24 extends through threaded aperture means 26 and bears against a recess, not shown, formed in sleeve 16 to hold said sleeve 16 against axial displacement. Housing 22, feedup rod 20, sleeve 16, mandrel 14, the wedge member and stone 12 all rotate conjointly when the tool 10 is in use. Importantly, the cylindrical trailing end 19 of feedup rod 20, in conventional honing tools, is slidably received within the boss means and is never out of sliding engagement therewith.

The parts referenced to this point are conventional; the parts described hereinafter are not and collectively form the subject matter of this invention.

Diametrically extending bore means 28 is formed in the cylindrical base 19 of feedup rod 20 as shown and receives pin member 30 therein when the novel apparatus is assembled as will be shown and described in more detail hereinafter.

Disc member 32 is axially honed and thus has a generally toroidal configuration; it is axially received by tubular sleeve member 34. It is critical to note that sleeve member 34 is disposed in abutting, axial alignment with the boss means that is integral with the trailing end of housing 22 and that cylindrical base means 19 of feeder rod 20 is slidably received within said boss means and sleeve member 34 when tool 10 is assembled and in use. Thus, the axial displacement of feedup rod 20 is greater in this invention than in the unmodified Sunnen tool, as will become more clear as this description proceeds and as is clearly shown in FIGS. 4 and 5; the boss means appears in FIGS. 4 and 5 and is there denoted 23. Thus, the wedge member in the improved tool must be of greater extent to allow for the additional travel of the feedup rod 20, i.e., in the present invention, the travel of cylindrical base means 19 of feedup rod 20 is not restricted to the boss means 23.

Sleeve member 34 axially receives adapter member 36 having a multifaceted shank 38 that is engagable by a drill means, not shown in FIG. 1. Alternatively, sleeve member 34 may also axially receive the output shaft of a motor, not shown in FIG. 1. Set screws 35, 37 are screwed threadedly received within internally threaded bore means 35*a*, 37*a*, respectively, formed in sleeve 34; said bore means 35*a*, 37*a* are circumferentially spaced ninety degrees from one another so that when set screws 35, 37 are tightened, adapter 36 does not slip relative to sleeve 34 when the drill or motor means is activated.

The toroidal disc-like member 32 will hereinafter be referred to as the feedup ring because its position determines the position of the feedup rod 20 and, ultimately, the radial position of stone 12.

Feedup ring 32 is joined to feedup rod 20 by pin member 30; ring 32 has a diametrically extending bore means formed therein to receive pin 30 so that a medial part of pin 30 extends through bore means 28 formed in the base 19 of feedup rod 20 and the opposite ends of pin 30 extend through diametrically opposed sections of said diametrically extending bore means. A first half of the diametrically extending bore means is denoted 40 in FIG. 1; the second half thereof is not shown in FIG. 1 to simplify the drawing. Pin 30 is tightly slidably received within bore means 40 so that it does not fall therefrom or fly therefrom when tool 10 is in use.

Sleeve member 34 is similarly provided with a longitudinally extending slot means having diametrically opposed parts; a first part of the slot means is denoted 42 in FIG. 1 and its opposite counterpart is not shown in that FIG. to simplify it. Thus, pin 30 and hence feedup ring 32 and feedup rod 20 are collectively slidably movable along the longitudinal extent of slot means 42 as indicated by the double-headed reference arrow 44. It should therefore be understood that as adapter 36 advances forwardly (toward stone 12) feedup ring 32 and feedup rod 20 will advance in the same direction in simultaneous and corresponding relationship therewith, and vice versa.

Figure 2:
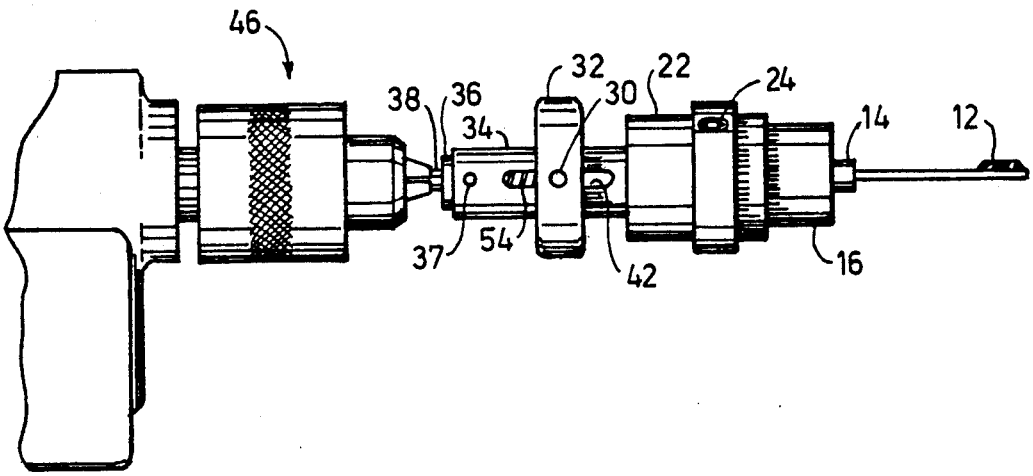
FIG. 2 is a side elevational view of the novel honing tool being engaged by a common drill member.

The aforementioned engagement of adapter 36 by a drill means is depicted in FIG. 2; the drill is generally denoted 46 and the parts of the assembly are identified by their respective reference numerals.

Figure 3:
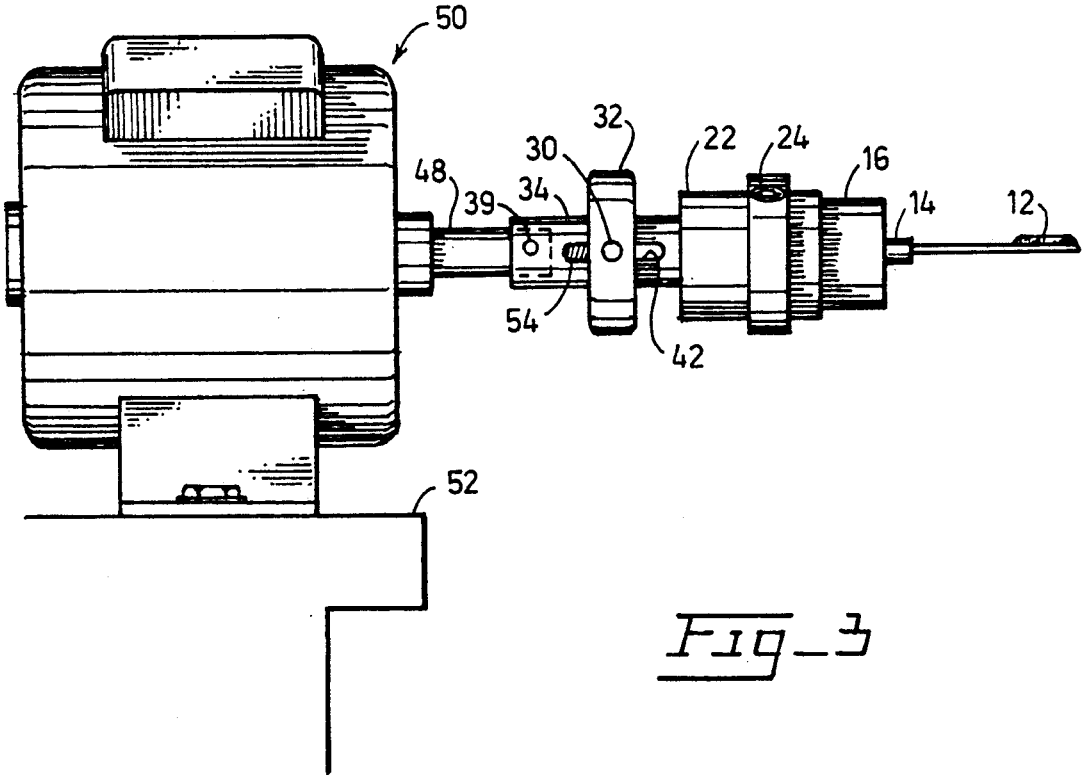
FIG. 3 is a side elevational view of the novel honing tool being engaged by a common motor means.

Moreover, the aforementioned engagement of sleeve 34 by the output shaft of a motor is depicted in FIG. 3. The output shaft 48 of motor means 50 is keyed for conjoint rotation with sleeve member 34 by set screws 35, 37 or by a diametrically extending pin member 39. Motor 50 is suitably mounted on a table 52 but drill 46 may be hand held through out the honing operation.

Figure 4:
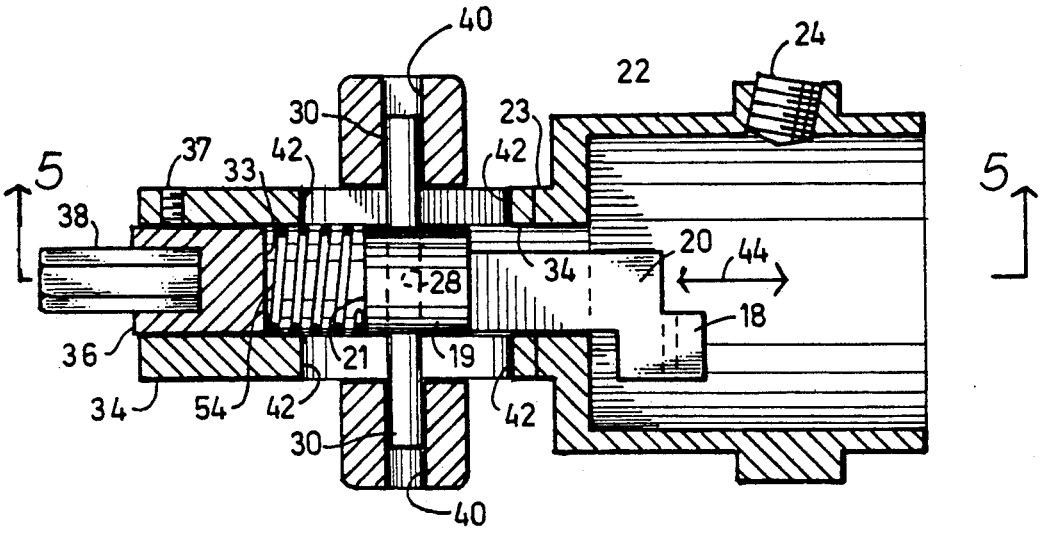
FIG. 4 is a longitudinal sectional view taken along line 4—4 in FIG. 5.
Figure 5:
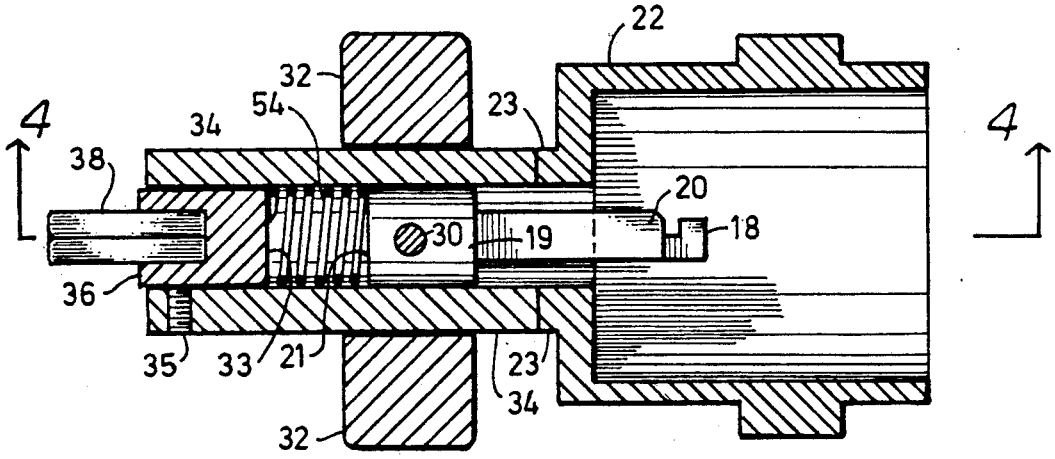
FIG. 5 is a longitudinal sectional view taken along line 5—5 in FIG. 4.

A spring member 54 is partly visible in FIGS. 2 and 3, through slot means 42. Spring 54, or other suitable bias means, extends between the leading end 33 of adapter member 36 or output shaft 48 and the trailing end 21 of feedup rod 20, as best shown in FIGS. 4 and 5. Thus, as leading end 33 advances to the right in FIGS. 4 and 5, spring 54 bears against trailing end 21 of base 19 of feedup rod 20 and thereby drives stone 12 radially outwardly. As the bias means 54 continues to urge stone 12 radially outwardly, the diameter of the bore being honed will increase.

When it is desired to measure the diameter of the bore being honed, the motor or drill is deactivated and feedup ring 32 is manually pulled back, i.e., to the left in FIGS. 4 and 5. Such retraction of feedup ring 32 compresses spring 54 and pulls feedup rod 20 to the left in said FIGS., thereby causing stone 12 to radially and longitudinally retract so that the bore diameter can be measured. Clearly, after the measurement has taken place, if further honing is needed, feedup ring 32 is released and the motor or drill is reactivated. No procedure could be simpler, as those skilled in the art of honing will appreciate. The unloading and loading of stone 12 by simple manipulation of feedup ring 32 is so easy that the bore diameter can be checked frequently, especially as the desired diameter of the bore is approached.

Importantly, the spring 54 serves as a cushioning means that enables drill 46 or the part being honed to be hand-held. Thus, if the drill or tool is abruptly moved in an axial direction, there will be no immediate catastrophic over-honing of the part being honed because the spring will cushion such abrupt movements. In this manner, movement "spikes" are attenuated.

Motor 50 can be placed under the control of a foot pedal that controls the starting and stopping thereof so that the starting and stopping is easily accomplished without tying up the operator's hands. A similar brake means may also be provided to further facilitate the starting and stopping of the motor. However, the need for repeated starting and stopping of the motor is greatly reduced by the second embodiment of the invention.

Figure 6:
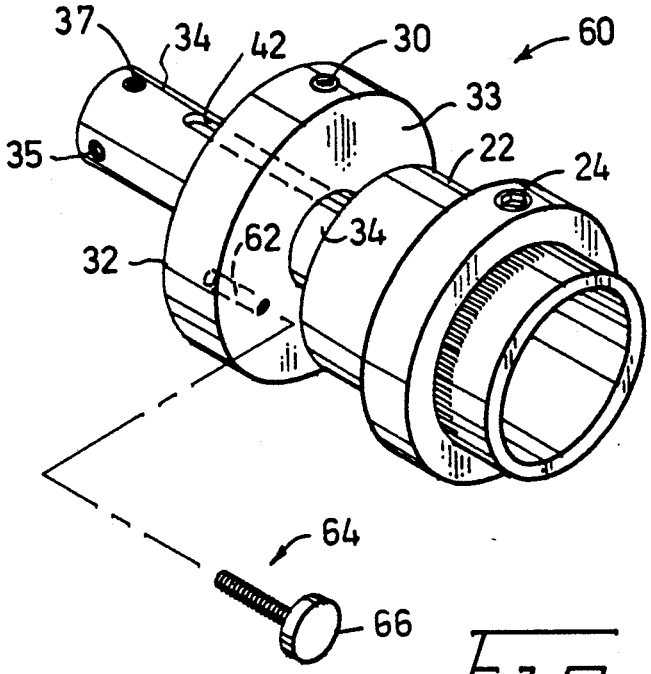
FIG. 6 is a perspective view of a second embodiment of the invention.
Figure 7:
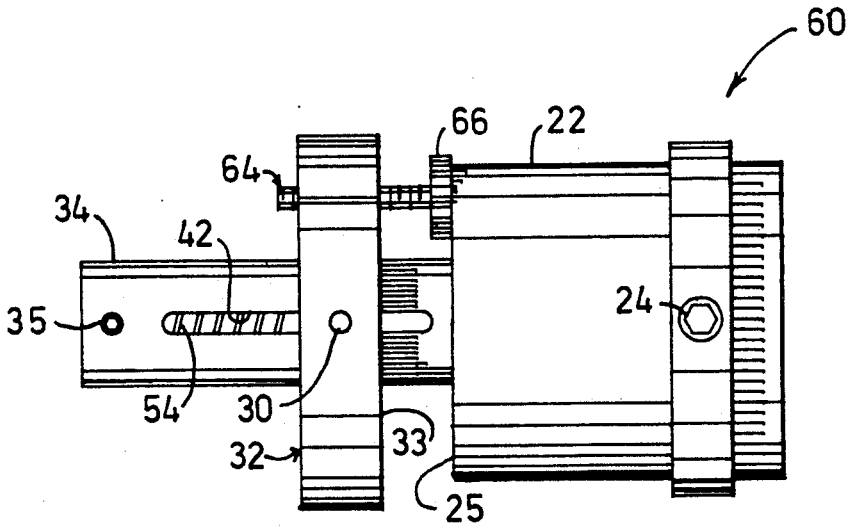
FIG. 7 is a side elevational view of the embodiment shown in FIG. 6.

The second embodiment is shown in FIGS. 6 and 7 and is denoted by the reference numeral 60 as a whole. A longitudinally extending, internally threaded bore means 62 is formed in feedup ring 32 and screw threadedly receives screw means or stop member 64 therein.

As shown in FIG. 7, stop member 64 has a head part 66 that abuts the trailing wall 25 of housing 22 when a particular honing procedure has been completed. For example, where dozens of bores are to be honed to the same diameter, screw means 64 is fully advanced into bore 62 so that head 66 thereof abuts the leading end wall 33 of feedup ring 32, or said means 64 is entirely removed from bore 62, and the desired bore is honed in the manner described in connection with the first embodiment. When the exact bore diameter has been achieved, the exact longitudinal position of the feedup ring 32 is marked with a suitable marker; stop member 64 is then screwed into bore 62 to the extent necessary to hold said feedup ring 32 in its final position for that bore. FIG. 7 shows head 66 in such position. Since bias means 54 continually urges the feedup ring 32 to the right in the configuration of FIG. 7, and since stop means 64 overcomes that bias and maintains the final position of feedup ring 32, said stop means serves as a memory means in that it stores the precise position of the feedup ring 32 for a bore of a particular diameter. Thus, dozens or scores of bores of the same particular diameter can now be produced without monitoring the tool 60 as it operates. Moreover, by calibrating the device so that the amount of change of bore diameter that is achieved by one complete turn of the screw, bores of varying diameters can easily be formed after the successful completion of one bore.

A final matter worthy of note is that boss means 23 is eliminated in the second embodiment and is also not shown in FIGS. 2 and 3 to indicate that both the first and second embodiments may be built without such boss means. Instead, the novel tubular sleeve 34 is made integral with housing 22 as depicted in all FIGS. except FIGS. 4 and 5.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. In a honing tool having a housing of the type where a tubular boss means is formed on a trailing end of the housing and where the trailing end of a feeding rod is slidably mounted for axial movement within said boss means, means for effecting axial travel of said feedup rod, comprising:

a tubular sleeve member having a leading end fixedly secured in open communication and in axial alignment with a trailing end of said boss means;

a bias means disposed in said sleeve member;

a leading end of said bias means being disposed in abutting relation to the trailing end of said feedup rod;

means external to said honing tool for compressing said bias means so that said bias means exerts pressure on said feedup rod;

a pair of diametrically opposed, longitudinally extending slot members being formed in said sleeve member;

a bore means being formed adjacent the trailing end of said feedup rod;

a linear-in-configuration pin member extending through said slot members and said bore means;

means for retaining said pin member in said slot members and said bore means;

said means for retaining said pin member comprising a feedup ring member of generally toroidal configuration;

said feedup ring member being centrally bored to axially receive said sleeve member; and said feedup ring member having a pair of diametrically opposed, radially disposed bore means formed therein to accommodate said pin member.

2. In the tool of claim 1, further comprising memory means for storing a final position of said feedup ring member relative to said slot members so that a plurality of bores can be successively honed to a common diameter by terminating a honing procedure when said feedup ring member achieves said final position as remembered by said memory means.

3. In the tool of claim 2, wherein said memory means includes a threaded longitudinally extending bore means formed eccentrically in said feedup ring member and a complementally threaded screw member that is screw threadedly received therein, said screw member having a leading end that abuts a trailing end of said housing when said feedup ring member is disposed in said final position.

4. In the tool of claim 1, wherein said boss means and said sleeve member are integrally formed with one another.

5. A honing tool, comprising:

a stone;

a mandrel for holding said stone;

a housing for holding said mandrel;

a boss means integral with a trailing end of said housing;

a feedup rod disposed in said housing;

said feedup rod having a cylindrical base means slidably disposable in said boss means, said base means being at the trailing end of said feedup rod;

a tubular sleeve member having a leading end formed integral with a trailing end of said boss means;

said base means of said feedup rod being slidably disposable in said sleeve member;

a bias means being disposed in said sleeve member;

said bias means having a leading end disposed in abutting relation to the trailing end of said feedup rod base means;

means for rotating said sleeve member;

said means for rotating said sleeve member being axially received in a trailing end of said sleeve member and being disposed in abutting relation to a trailing end of said bias means;

means securing said means for rotating said sleeve member to said sleeve member to provide conjoint rotation between said sleeve member and said means for rotating it;

means for providing conjoint rotation between said feedup rod and said sleeve member;

a pair of diametrically opposed, longitudinally extending slot means being formed in said tubular sleeve member; and said means for providing conjoint rotation between said feedup rod and said sleeve member including a diametrically extending bore means formed in the cylindrical base means of said feedup rod and a pin member that extends through said slot means and said bore means to thereby couple together said sleeve member and said feedup rod.

6. The honing tool of claim 5, wherein said means for providing conjoint rotation between said feedup rod and said sleeve member further comprises a generally toroidal in configuration feedup ring that is centrally bored and which axially receives said tubular sleeve member, said feedup ring having a diametrically extending bore means formed therein that tightly slidably receives opposite ends of said pin member therein, said diametrically extending bore means being disposed in alignment with the bore means formed in the base means of said feedup rod and said pin member extending through said aligned bore means.

7. The honing tool of claim 6, further comprising memory means for storing a final position of said feedup ring member relative to said slot means so that a plurality of bores can be successively honed to a common diameter by terminating a honing procedure when said feedup ring achieves said final position as remembered by said memory means.

8. The honing tool of claim 7, wherein said memory means includes a threaded longitudinally extending bore means formed eccentrically in said feedup ring and a complementally threaded screw member that is screw threadedly received therein, said screw member having a leading end that abuts a trailing end of said housing when said feedup ring is disposed in said final position.

* * * * *